US009415414B2

(12) United States Patent
Ren

(10) Patent No.: US 9,415,414 B2
(45) Date of Patent: Aug. 16, 2016

(54) SPEED AND ANGLE ADJUSTABLE DIP-COATING FILM FORMING DEVICE

(71) Applicant: POLYMER SCIENCE (SHENZHEN) NEW MATERIALS CO., LTD., Shenzhen (CN)

(72) Inventor: Changyi Ren, Shenzhen (CN)

(73) Assignee: Polymer Science (Shenzhen) New Materials CO., LTD., Guangdong (CN)

( * ) Notice: Subject to any disclaimer, the term of this patent is extended or adjusted under 35 U.S.C. 154(b) by 16 days.

(21) Appl. No.: 14/397,143

(22) PCT Filed: Apr. 25, 2013

(86) PCT No.: PCT/CN2013/074692
§ 371 (c)(1),
(2) Date: Oct. 24, 2014

(87) PCT Pub. No.: WO2013/159712
PCT Pub. Date: Oct. 31, 2013

(65) Prior Publication Data

US 2015/0128854 A1 May 14, 2015

(30) Foreign Application Priority Data

Apr. 25, 2012 (CN) ..... 2012 1 0124672

(51) Int. Cl.

| | |
|---|---|
| ***B05C 3/02*** | (2006.01) |
| ***B05C 13/02*** | (2006.01) |
| ***B05C 3/09*** | (2006.01) |
| *B05B 13/02* | (2006.01) |

(52) U.S. Cl.
CPC ... *B05C 3/02* (2013.01); *B05C 3/09* (2013.01); *B05B 13/0221* (2013.01)

(58) Field of Classification Search
USPC ..... 118/400, 423, 425, 428, 429, 500
See application file for complete search history.

(56) References Cited

U.S. PATENT DOCUMENTS 1,332,934 A * 3/1920 Tenca ..... B05C 3/02 118/425
2,236,605 A * 4/1941 Ozouf ..... A22B 5/08 118/423

FOREIGN PATENT DOCUMENTS

WO 2013159712 A1 10/2013

* cited by examiner

*Primary Examiner* — Yewebdar Tadesse
(74) *Attorney, Agent, or Firm* — Dicke, Billig & Czaja PLLC

(57) ABSTRACT

A speed and angle adjustable dip-coating film forming device includes: a base; two swing rods, where the two swing rods are disposed opposite to each other, separately movably connected to the base, and capable of swinging relative to the base; two angle fixing racks, separately disposed on two sides of the base and capable of fixing positions of the swing rods; a power element, disposed on the swing rods; and a lifting rack, movably disposed on the swing rods, and capable of swinging with the swing rods and being driven by the power element to move vertically along the swing rods. A lifting angle can be changed by swinging the swing rods and fixing the swing rods by using the angle fixing racks, and a lifting speed can be changed by changing a moving speed of the lifting rack by using the power element.

9 Claims, 5 Drawing Sheets

SPEED AND ANGLE ADJUSTABLE DIP-COATING FILM FORMING DEVICE

BACKGROUND

1. Technical Field

The present invention relates to the technical field of dip-coating film forming devices, and in particular, to a speed and angle adjustable dip-coating film forming device.

2. Related Art

The dip-coating method is a very commonly used thin film preparation method. By applying the method, a uniform thin film can be coated on a tabular or cylindrical substrate. The method is widely applied in lifting based film formation of a sol-gel, a solution, and a suspension. Specific operations of the dip-coating method are as follows: An entire clean substrate is dipped into a sol or solution or suspension that is prepared in advance, and then the substrate is lifted out of the sol or solution or suspension. With the action of the viscosity and gravity, a liquid film is formed on a surface of the substrate. Next, a solvent in the liquid film on the substrate surface evaporates quickly. Accordingly, a thin film is formed on the substrate surface.

In a process of preparing a thin film by using the dip-coating method, main factors affecting the thin film quality include a solvent type, a lifting speed, a lifting angle, and the like. In a dip-coating process, the method requires that a speed of lifting the substrate should be stable and no shaking or joggling should occur; otherwise, the prepared thin film is not uniform in thickness, and therefore the quality of the thin film is lowered.

Existing dip-coating film forming devices mainly use a hanger type design. When a substrate is lifted, shaking and other unstable phenomena easily occur and a lifting angle is not adjustable. Therefore, lifting based film formation can only be performed with a vertical angle, and a structure of a formed film cannot be changed by changing a dip-coating angle, so that the effect of the lifting angle on a dip-coating process is difficult to study.

Defects of the dip-coating film forming devices in the prior art limit application, promotion, and standardization of dip-coating film formation in thin film preparation. With the development of thin film materials with nano functions, a speed and angle adjustable dip-coating film forming device becomes urgent in scientific research and teaching experiments.

SUMMARY

The objective of the present invention is to provide a speed and angle adjustable dip-coating film forming device, including: a base; two swing rods disposed opposite to each other, separately movably connected to the base, and capable of swinging relative to the base; two angle fixing racks separately disposed on two sides of the base and capable of fixing positions of the swing rods; a power element disposed on the swing rods; and a lifting rack movably disposed on the swing rods, and capable of swinging with the swing rods and being driven by the power element to move vertically along the swing rods.

Further, a rotational structure capable of making the two swing rods swing relative to the base is disposed between the swing rods and the base.

Further, the rotational structure includes a bearing housing disposed on the base and a first rotational rod that is disposed in and passes through the bearing housing, and each of the two swing rods has one end connected to the first rotational rod and the other end extending upward.

Further, each of the angle fixing rack is right angle shaped, and is provided with an arc-shaped bar, an arc-shaped track is disposed in the arc-shaped bar, each of the swing rods is provided with a protruded bar that is disposed in and passes through the arc-shaped track and is capable of sliding along the arc-shaped track, and the protruded bar is provided with a fastener capable of fastening the protruded bar on the arc-shaped bar.

Further, upper ends of the swing rods are provided with a fastening rack capable of swinging with the swing rods, the power element is fastened on the fastening rack, and the lifting rack is movably connected to the fastening rack.

Further, the power element drives, by using a transmission mechanism, the lifting rack to move vertically along the swing rod.

Further, the transmission mechanism includes a second rotational rod, the second rotational rod is driven by the power element, rotation of the second rotational rod is capable of driving the lifting rack to move vertically along the swing rods, the fastening rack is provided with a bearing, and the second rotational rod is disposed in and passes through the bearing.

Further, the second rotational rod is provided with a gear, and the lifting rack is provided with a toothed bar capable of engaging the gear.

Further, a slide rail structure capable of making the lifting rack movably connected to the fastening rack is disposed between the lifting rack and the fastening rack.

Further, the slide rail structure includes convex rails or concave rails separately disposed at two sides of the fastening rack, and concave rails or convex rails separately disposed at two sides of the lifting rack capable of matching the convex rails or concave rails.

Compared with the prior art, in the dip-coating film forming device in this embodiment, the swing rods swing and the swing rods after the swinging can be fixed by using the angle fixing racks, so that a lifting angle is changed, and the power element can change a moving speed of the lifting rack so that a lifting speed is changed, thereby ensuring repeatability of operations of the device and uniformity of the lifting speed; in addition, no shaking occurs on the lifting rack in a process of lifting a substrate on which a film needs to be formed, which is stable, thereby ensuring the quality of the film formed on the substrate.

BRIEF DESCRIPTION OF THE DRAWINGS

The disclosure will become more fully understood from the detailed description given herein below for illustration only, and thus are not limitative of the disclosure, and wherein.

DETAILED DESCRIPTION

In order to make the objectives, technical solutions, and advantages of the present invention more comprehensible, the present invention is described in further detail below with reference to the accompanying drawings and embodiments. It should be understood that, the specific embodiment described herein is merely used for explaining the present invention, instead of limiting the present invention.

The present invention provides a speed and angle adjustable dip-coating film forming device, including: a base; two swing rods disposed opposite to each other, separately movably connected to the base, and capable of swinging relative to the base; two angle fixing racks separately disposed on two sides of the base and capable of fixing positions of the swing rods; a power element disposed on the swing rods; and a lifting rack movably disposed on the swing rods, and capable of swinging with the swing rods and being driven by the power element to move vertically along the swing rods.

In the present invention, a substrate on which a film needs to be formed is fastened on the lifting rack, and the lifting rack moves vertically, so that the substrate can be dipped into a solution or lifted out of the solution, thereby achieving the objective of forming a film on a substrate surface. In this device, the lifting rack swings with the swing rods and therefore can change a lifting angle, and the power element can be used to change a lifting speed of the lifting rack. In this way, repeatability of operations of the device is ensured, and during lifting, the lifting rack is operated smoothly and stably at a uniform speed, so that the quality of the film formed on the substrate can be ensured.

Implementation of the present invention is described in detail below with reference to specific accompany drawings.

Figure 1:
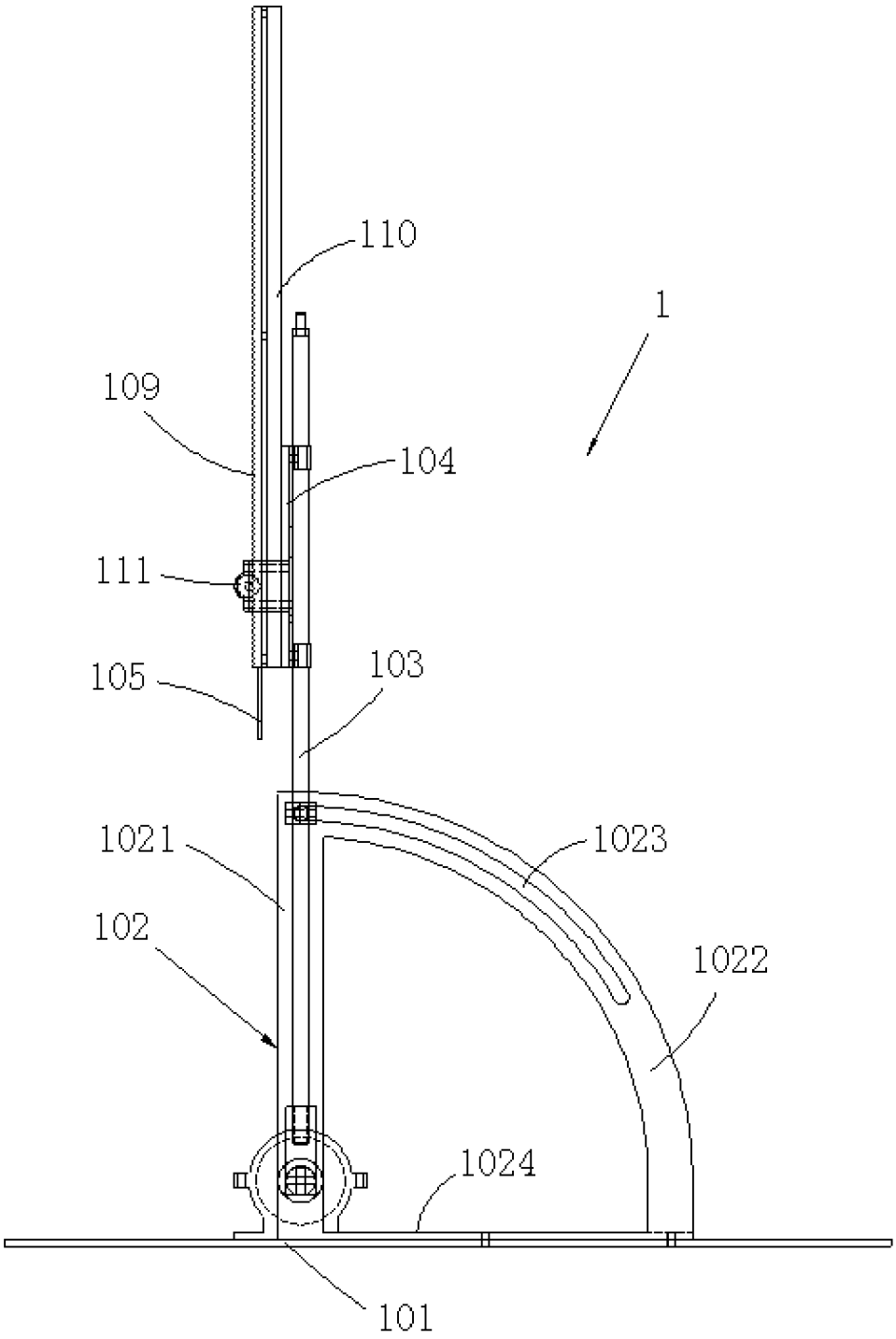
FIG. 1 is a schematic side view of a dip-coating film forming device according to an embodiment of the present invention.
Figure 2:
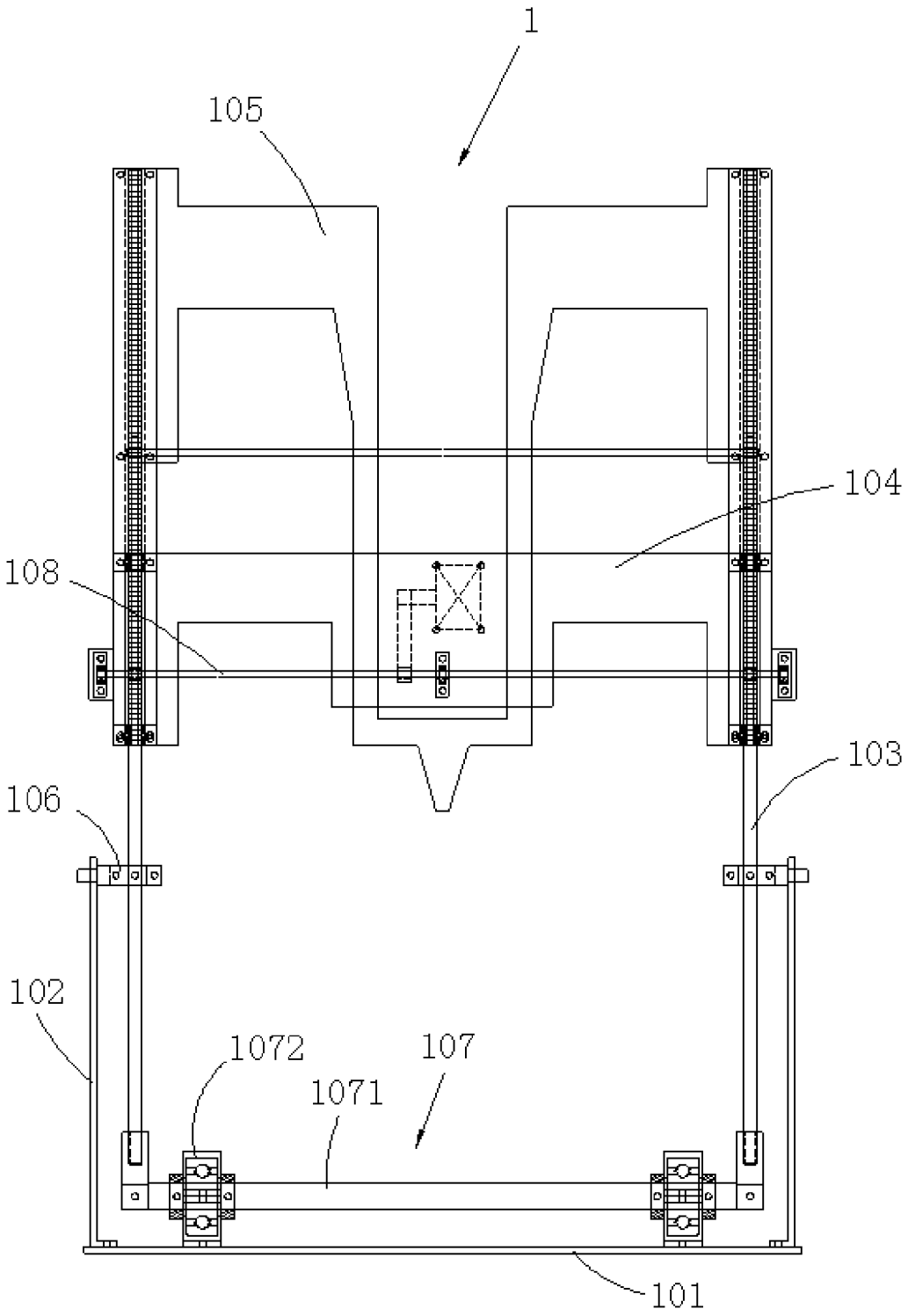
FIG. 2 is a schematic front view of a dip-coating film forming device according to an embodiment of the present invention.
Figure 3:
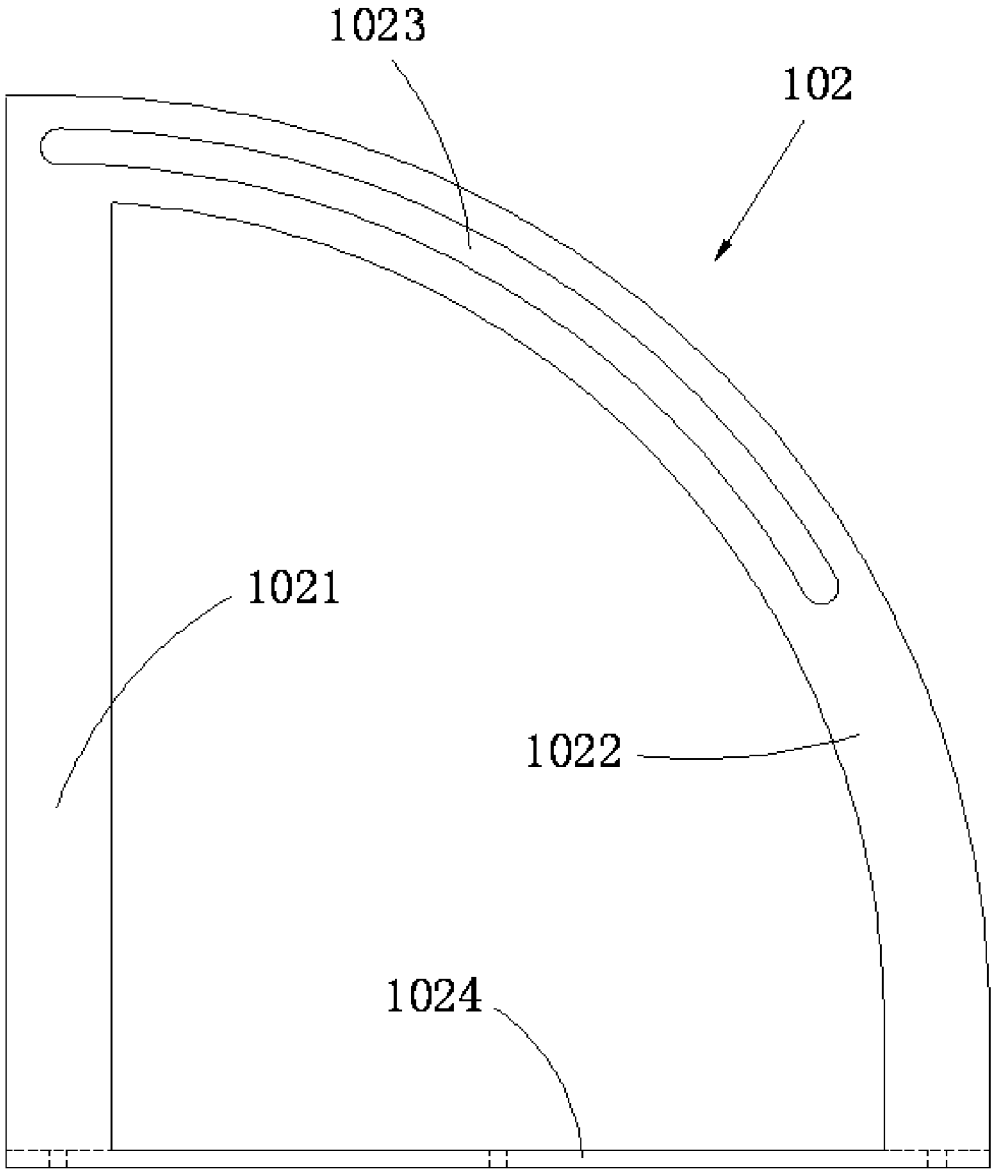
FIG. 3 is a schematic front view of an angle fixing rack according to an embodiment of the present invention.
Figure 4:
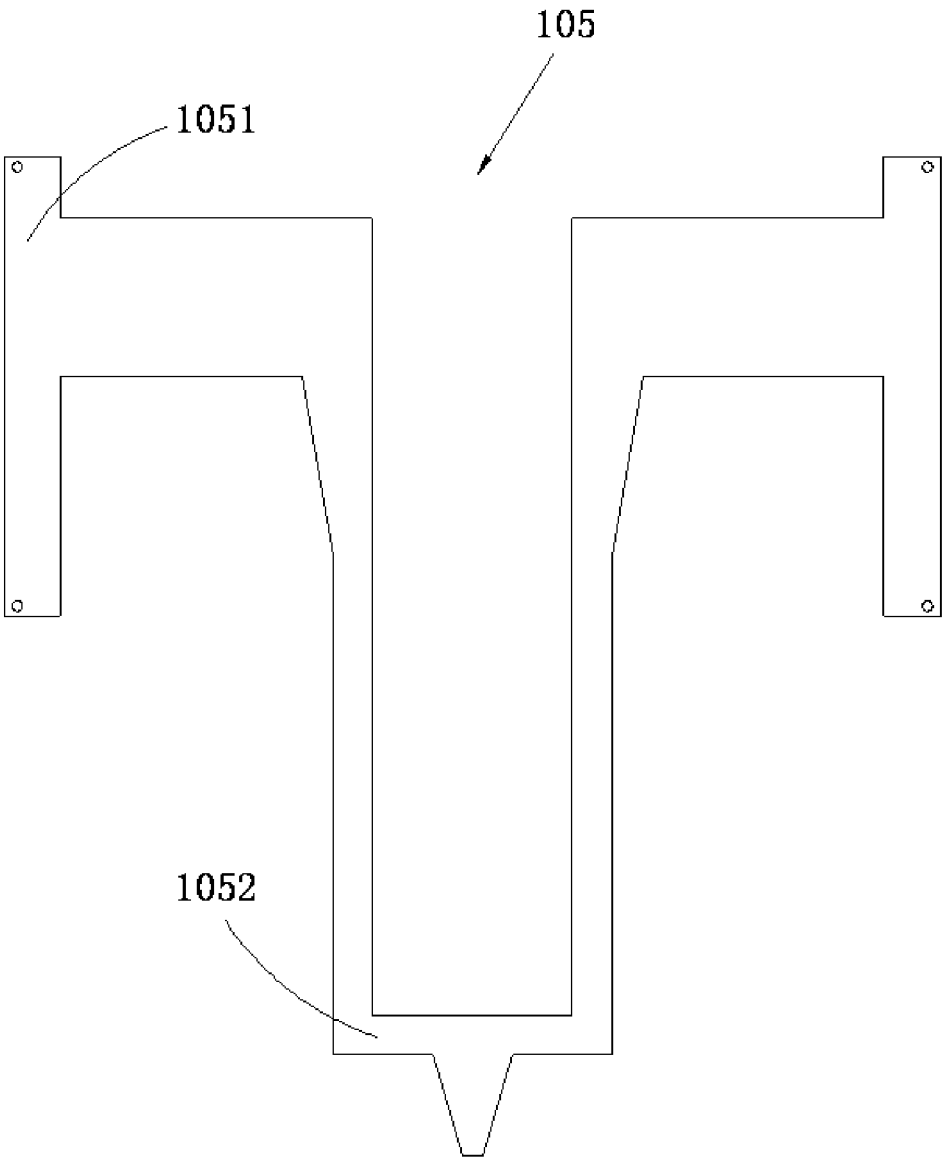
FIG. 4 is a schematic front view of a lifting rack according to an embodiment of the present invention.
Figure 5:
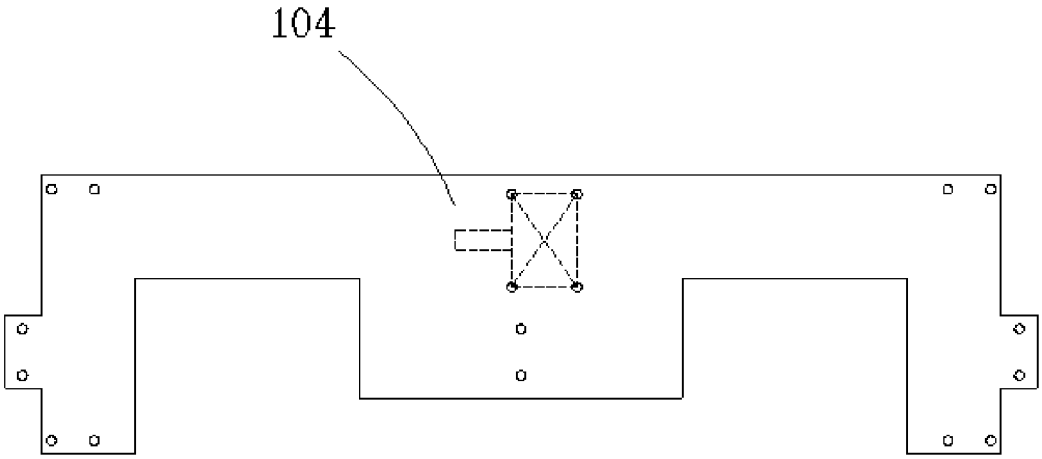
FIG. 5 is a schematic front view of a fastening rack according to an embodiment of the present invention.

As shown in FIG. 1 to FIG. 5, a preferred embodiment is provided by the present invention.

A dip-coating film forming device 1 provided by the present invention is used to form a uniform thin film on a surface of a tabular or cylindrical substrate.

The dip-coating film forming device 1 includes: a base 101; two swing rods 103 separately movably connected to the base 101 and capable of swinging relative to the base 101; two angle fixing racks 102 separately disposed on two sides of the base 101; a power element disposed on the swing rods 103; and a lifting rack 105 capable of being driven by the power element to move vertically along the swing rods 103. As a bottom support of the entire dip-coating film forming device 1, the base 101 functions to bear load. The two swing rods 103 are disposed opposite to each other and distributed at the two sides of the base 101; and the two are capable of simultaneously swinging relative to the base 101, so as to change an angle of the swing rods 103 relative to the base 101. The two angle fixing racks 102 are also disposed at the sides of the base 101 relative to the two swing rods 103; after the swing rods 103 swing to a required angle, the two angle fixing racks 102 are capable of separately fixing the two swing rods 103, to retain a relative angle between the swing rods 103 and the base 101. The power element is fastened on the swing rods 103 and capable of swinging with swinging of the swing rods 103 so as to swing relative to the base 101, and mainly functions to provide power for movement of the lifting rack 105. The lifting rack 105 is movably connected to the swing rods 103 and capable of swinging with the swinging of the swing rods 103 so as to change an angle of the lifting rack 105 relative to the base 101, and by depending on the power of the power element, is capable of moving vertically along the swing rods 103; a tabular or cylindrical substrate externally needing coating may be connected to a lower end of the lifting rack 105, so as to be dipped into a sol solution or another solution with vertical movement of the lifting rack 105 along the swing rods 103, and to be lifted out of the solution with rising of the lifting rack 105 after staying in the solution for a while, so that next-step processing is performed. Certainly, a moving speed of the lifting rack 105 is completely controlled by the power element, and therefore an operation person can select an optimal lifting speed for the lifting rack 105 by controlling the power element.

In this embodiment, an operation person may control the power element by using an automatic control method, for example, use a computer to implement automatic control on the lifting speed of the lifting rack 105, or manually control the power element. The specific method may be determined according to an actual requirement.

When the dip-coating film forming device 1 is used to perform surface coating for a tabular or cylindrical substrate, the tabular or cylindrical substrate may be fastened on the lower end of the lifting rack 105, the lifting rack 105 moves vertically so that the tabular or cylindrical substrate is dipped into a solution or lifted out of the solution, the angle of the swing rods 103 relative to the base 101 is changed so that the angle of the lifting rack 105 relative to the base 101 can be changed, that is, the lifting angle can be changed, and the lifting speed of the lifting rack 105 can be controlled by using the power element, so that the speed and angle of the lifting rack 105 are adjustable; the angle fixing racks 102 at the two sides fix the swing rods 103 at the two sides so that it can be ensured that the angle of the swing rods 103 remains unchanged during movement of the lifting rack 105, and the base 101 is stable so that no shaking occurs on the lifting rack 105, thereby ensuring the quality of a film formed on a surface of the tabular or cylindrical substrate.

In this embodiment, the two swing rods 103 are separately connected to the base 101 by using a rotational structure 107, and with the action of the rotational structure 107, the two swing rods 103 are capable of swinging relative to the base 101.

Specifically, two bearing housings 1072 are disposed on the base 101, the two bearing housings 1072 are provided with a first rotational rod 1071 passing through the bearing housings 1072 and capable of rotating in the bearing housings 1072, one end of each of the two swing rods 103 is separately connected to two ends of the first rotational rod 1071 so that with the action of the first rotational rod 1071, the two swing rods 103 are capable of simultaneously swinging on the base 101 so as to form various angles with the base 101, and the other end of each of the swing rods 103 extends upward.

Each of the angle fixing racks 102 is right angle shaped, and includes a fastening bar 1024 fastened on the base 101, a vertical bar 1021 perpendicular to the fastening bar 1024, and an arc-shaped bar 1022 separately connected to the fastening bar 1024 and the vertical bar 1021, and the arc-shaped bar 1022 is provided with an arc-shaped track 1023, that is, the arc-shaped bar 1022 is equivalent to the hypotenuse of the right angle shaped angle fixing rack 102.

One end of each of the swing rods 103 is movably connected to the base 101, and provided with a protruded bar 106 capable of sliding in the arc-shaped track 1023. The protruded bar 106 is disposed in and passes through the arc-shaped track 1023, and when the swing rod 103 swings relative to the base 101, the protruded bar 106 accordingly slides along the arc-shaped track 1023; in this way, matching of the protruded bar 106 and the arc-shaped track 1023 also functions to position swinging of the swing rod 103. In addition, the protruded bar 106 is provided with a fastener, such as a nut, capable of fastening the protruded bar 106 on the arc-shaped bar 1022.

The arc-shaped track 1023 in the arc-shaped bar 1022 is set so that ultimate swinging positions of the swing rod 103 can be limited. In this embodiment, when the swing rod 103 swings to two ultimate positions of the arc-shaped track 1023, angles between the swing rod 103 and the horizontal direction are 90° and 30° separately, that is, the swing rod 103 is capable of swinging in a range of forming a 30° to 90° angle with the horizontal direction. Certainly, this angle changing range already meets an actual requirement; for some special requirements, the angle changing range can be changed by designing the arc-shaped track 1023.

In this embodiment, the swing rods 103 are provided with a fastening rack 104, two ends of the fastening rack 104 are separately connected to upper ends of the two swing rods 103, and the power element is fastened on the fastening rack 104.

In order for the power element to drive the lifting rack 105 to move vertically along the swing rods 103, in this embodiment, the power element drives, by using a transmission mechanism 108, the lifting rack 105 to move.

Specifically, the transmission mechanism 108 includes a second rotational rod capable of rotating under the drive of the power element, the second rotational rod may be rotatably connected to the fastening rack 104, that is, capable of rotating on the fixing rack 104 under the drive of the power element, and rotation of the second rotational rod is capable of driving the lifting rack 105 to move vertically along the swing rods 103. Certainly, the power element may be a stepping motor or the like, and drives, in a common manner such as a belt transmission manner or a chain transmission manner, the second rotational rod to rotate. The specific manner may be determined according to an actual requirement.

The second rotational rod is disposed in and passes through a bearing, and the bearing is disposed on the fastening rack 104, so that the second rotational rod is capable of rotating on the fastening rack 104.

In order for the second rotational rod to drive the lifting rack 105 to move vertically, the second rotational rod is provided with a gear 111, the gear 111 is capable of rotating with the rotation of the second rotational rod; and correspondingly, the lifting rack 105 is provided with a toothed bar 109, and the gear 111 engages the toothed bar 109, and when the gear 111 rotates, the gear 111 is capable of driving the toothed bar 109 to move, so that the lifting rack 105 moves vertically.

In order for the lifting rack 105 to move smoothly and stably, on which no shaking occurs, in this embodiment, a slide rail structure 110 is disposed between the lifting rack 105 and the fastening rack 104, that is, the lifting rack 105 moves to match the slide rail structure 110; in this way, shaking of the lifting rack 105 can be avoided, so as to ensure the quality of the film formed on the tabular or cylindrical substrate.

Specifically, the slide rail structure includes concave rails separately fastened at two sides of the fastening rack 104 and convex rails separately fastened at two sides of the lifting rack 105 and capable of matching the concave rails to move, and the convex rails are embedded in the concave rails and capable of moving along the concave rails Certainly, the concave rails may also be disposed at the two sides of the lifting rack 105, and the convex rails are disposed at the two sides of the fastening rack 104, so as to implement matching between the lifting rack 105 and the fastening rack 104 for movement.

In this embodiment, the toothed bar 109 is fastened at a lateral side of a concave rail or convex rail on the lifting rack 105. Certainly, the toothed bar 109 may also be fastened at another position of the lifting rack 105, and the specific position may be determined according to an actual requirement.

In this embodiment, mounting portions 1051 for mounting the concave rails or convex rails are disposed at the two sides of the lifting rack 105, and the middle of the lifting rack 105 extends downward to form a fastening portion 1052 for fastening a substrate or slab externally needing coating.

The foregoing description is merely a preferred embodiment of the present invention, and a person of ordinary skill in the art may make variations to the specific embodiment according to the idea of the present invention.

The invention claimed is:

1. A speed and angle adjustable dip-coating film forming device, comprising:

a base;

two swing rods, wherein the two swing rods are disposed opposite to each other, separately movably connected to the base, and capable of swinging relative to the base;

two angle fixing racks, separately disposed on two sides of the base and capable of fixing positions of the swing rods;

a power element, disposed on the swing rods; and a lifting rack, movably disposed on the swing rods, and capable of swinging with the swing rods and being driven by the power element to move vertically along the swing rods, wherein each of the angle fixing racks is right angle shaped, and is provided with an arc-shaped bar, an arc-shaped track is disposed in the arc-shaped bar, each of the swing rods is provided with a protruded bar that is disposed in and passes through the arc-shaped track and is capable of sliding along the arc-shaped track, and the protruded bar is provided with a fastener capable of fastening the protruded bar on the arc-shaped bar.

2. The device according to claim 1, wherein a rotational structure capable of making the two swing rods swing relative to the base is disposed between the swing rods and the base.

3. The device according to claim 2, wherein the rotational structure comprises a bearing housing disposed on the base and a first rotational rod that is disposed in and passes through the bearing housing, and each of the two swing rods has one end connected to the first rotational rod and the other end extending upward.

4. The device according to claim 1, wherein upper ends of the swing rods are provided with a fastening rack capable of swinging with the swing rods, the power element is fastened on the fastening rack, and the lifting rack is movably connected to the fastening rack.

5. The device according to claim 4, wherein the power element drives, by using a transmission mechanism, the lifting rack to move vertically along the swing rod.

6. The device according to claim 5, wherein the transmission mechanism comprises a second rotational rod, the second rotational rod is driven by the power element, rotation of the second rotational rod is capable of driving the lifting rack to move vertically along the swing rods, the fastening rack is provided with a bearing, and the second rotational rod is disposed in and passes through the bearing.

7. The device according to claim 6, wherein the second rotational rod is provided with a gear, and the lifting rack is provided with a toothed bar capable of engaging the gear.

8. The device according to claim 4, wherein a slide rail structure capable of making the lifting rack movably connected to the fastening rack is disposed between the lifting rack and the fastening rack.

9. The device according to claim 8, wherein the slide rail structure comprises convex rails or concave rails separately disposed at two sides of the fastening rack, and concave rails or convex rails separately disposed at two sides of the lifting rack capable of matching the convex rails or concave rails.

* * * * *